US006068025A

United States Patent [19]

Schlecht

[11] Patent Number: 6,068,025

[45] Date of Patent: May 30, 2000

[54] DELIVERY LINE FOR CEMENT

[75] Inventor: Karl Schlecht, Filderstadt, Germany

[73] Assignee: Putzmeister Aktiengesellschaft, Aichtal, Germany

[21] Appl. No.: 08/804,226

[22] Filed: Feb. 21, 1997

[51] Int. Cl.[7] ..... F16L 9/00; B65G 53/42

[52] U.S. Cl. ..... 138/109; 222/611.2; 406/157

[58] Field of Search ..... 138/109; 222/611.2, 222/387

[56] References Cited

U.S. PATENT DOCUMENTS

| | | | |
|---|---|---|---|
| 3,758,163 | 9/1973 | Kalisiak | 406/116 |
| 3,794,386 | 2/1974 | Hite | 406/152 |
| 4,009,913 | 3/1977 | Beugelink | 406/157 |
| 4,813,817 | 3/1989 | Junier | 406/89 |

FOREIGN PATENT DOCUMENTS

| | | |
|---|---|---|
| 31 39 675 | 4/1893 | Germany . |
| 7538594 | 12/1975 | Germany . |
| 27 23 810 | 12/1977 | Germany . |
| 7738100 | 12/1977 | Germany . |
| 79 16 198 | 11/1979 | Germany . |
| 32 16 343 | 11/1982 | Germany . |
| 32 24 755 | 1/1984 | Germany . |
| 32 10 668 | 10/1992 | Germany . |
| 33 10 176 | 7/1993 | Germany . |
| 195 43 751 | 5/1996 | Germany . |

*Primary Examiner*—Patrick Brinson
*Attorney, Agent, or Firm*—Kenyon & Kenyon

[57] ABSTRACT

The invention relates to a pressure feed line for concrete, particularly for use in concrete distributor masts of mobile and stationary concrete pumps. Pressure feed lines of this type generally contain an end hose (12) arranged on the mast tip (10) of the distributor mast, which points down with its outlet aperture (16), via which the transported concrete is discharged on the construction site. In order to avoid undesirable demixing in the end hose, even if the concrete is being pumped slowly, is stiff or low in sand, it is proposed, according to the invention, that an expansion throttle (18) which can be spread open under the effect of the exiting concrete is arranged in the region of the outlet aperture (16) of the end hose (12).

30 Claims, 5 Drawing Sheets

DELIVERY LINE FOR CEMENT

FIELD OF THE INVENTION

The invention relates to a pressure feed line for concrete, with an end hose having an outlet aperture which points downward, preferably made of elastomer material, and with an expansion throttle arranged in the region of the outlet aperture of the end hose.

RELATED TECHNOLOGY

Pressure feed lines of this type are arranged, for example, on the concrete distributor mast of a stationary or mobile concrete pump. There, the end hose hangs down from the mast tip, and, at a construction site, serves to introduce the transported concrete into a prepared form. In practice, it has been proven, particularly when slowly feeding a stiff, low-sand concrete, that demixing phenomena and non-uniform concrete distribution can occur. The slowly flowing concrete freely falls down in the end hose, and breaks up into individual clumps during free fall. During this process, coarse gravel drops down at high speed, and bounces off in all directions, for example off a shielding located underneath. The content of micropores in the concrete is also detrimentally reduced because of the demixing phenomena. When the concrete pump is stopped, the concrete still continues to flow, without being controlled, for quite some time, which makes handling difficult and results in quite a significant loss of time for subsequent work.

In order to avoid this disadvantage, it is already known (DE-GM [utility model] 77 38 100), for a pressure feed line of the type stated initially, to provide a closure shell with gusset cuts in the region of the outlet aperture of the end hose, onto which an elastically deformable rubber cap which covers the gusset cuts is set; this cap has a central orifice aperture, is fitted to the shape of the closure shell in its non-deformed state, and can be pressed on from the direction of its orifice aperture against the concrete feed pressure. The known expansion throttle has not proven itself in practice, because of the danger of clogging which exists in the region of the closure shell which is held together by the rubber cap.

SUMMARY OF THE INVENTION

Proceeding from this, the invention is based on the task of improving the end hose of the known feed line of the type stated initially, in such a way that the expansion throttle does not clog, and nevertheless undesirable lateral edit of concrete in the region of the outlet aperture is avoided.

To accomplish this task, the combination of characteristics indicated in claim 1 is proposed. Advantageous forms and further developments of the present invention are evident in the dependent claims.

The solution according to the invention is based on the idea that the expansion throttle is surrounded over at least part of its length by a concentric rebound sheath, arranged at a radial distance from the throttle surface, which ensures that no material such as cement milk can splash away laterally out of the open expansion throttle and contaminate the surroundings. For the remainder, the measures according to the invention achieve the result that the expansion throttle releases a larger or smaller outlet cross-section on the end hose, depending on the feed amount. If the feed amount is sufficiently large, the expansion throttle is opened completely, so that the concrete can exit from the end hose in a complete stream. The less the flow, the more the expansion throttle closes, and thereby releases a correspondingly smaller diameter for the flowing concrete. When the pump is stopped, concrete will continue to flow only for a short time, until small pebbles temporarily close the remaining aperture of the expansion throttle and prevent further exit. When the pump is started again, this assembly of stones is easily removed by the concrete when it starts to flow.

An advantageous form of the invention provides that the expansion throttle has a nozzle part which is releasably attached at the delimitation edge, on the end hose side, of the outlet aperture, and a throttle part which projects downward beyond the end hose, with a cross-section that is smaller than the nozzle part, but can be elastically spread open under the effect of the thick, flowing substances. It is practical if at least the throttle part of the expansion throttle consists of elastomer material.

Another solution variation provides that the throttle part of the expansion throttle has the shape of a cone sleeve which diverges toward its end on the outlet side, and can be elastically spread open, which preferably has several expansion blades, arranged uniformly over the circumference of the sleeve, separated from one another by means of mantle slits and connected with one another at their root, on the nozzle side. At least three mantle slits are provided, and it is practical if these are open on the end at the exit side. The expansion blades are pre-stressed in the closing direction of the throttle part, so that they rest against one another in the non-expanded state, in the region of the mantle slits, under this pre-stress, and only leave a central, relatively small outlet aperture open.

The expansion throttle according to the invention, with the expansion blades separated by mantle slits, simultaneously has the function of an air separator, which prevents air entrained in the concrete from being expelled downward through the outlet aperture, at high energy, taking along a concrete plug. This is because before the concrete passes through the expansion throttle, any compressed air which might be present can escape laterally through the slits. In this manner, the exit velocity of the concrete and therefore the risk of demixing are reduced. For a further improvement in this regard, it is proposed, according to an advantageous further development of the invention, that the mantle slits are widened at the root end of the expansion blades, forming relief apertures or bores on the mantle side. The relief apertures simultaneously have the function of an anti-tear protection, and improve the expandability of the expansion blades.

In order to prevent material such as cement milk from being entrained laterally with the air that exits through the mantle slits and relief apertures, it is proposed, according to the invention, that the expansion throttle is surrounded over at least part of its length by a preferably concentric rebound sheath. The rebound sheath can be releasably attached behind a circumference bead on the expansion throttle or the end hose, by means of a clamp element, preferably with a positive lock. The circumference bead also has a reinforcing function in the root region of the expansion blades, which has a positive influence on the spring effect of the expansion blades.

A further improvement in the handling ability of the concrete pump can be achieved if the passage cross-section of the expansion throttle or the expansion characteristics of the expansion throttle, which define the passage cross-section as a function of the transported amount or the feed pressure of the thick, flowing material, can be adjusted from the outside, or if the expansion throttle can be closed with external means. For this purpose, the expansion throttle can be surrounded by a ring bellows which can be inflated with compressed air, where the ring bellows can, at the same time, take on the function of the rebound sheath.

Another advantageous form of the invention provides that the expansion throttle can be releasably attached to the end hose by means of a suitable hose connector. For this purpose, it is practical if the hose connector has an inside sleeve which engages in the end hose and in the nozzle part, and at least one clamp ring which clamps the end hose and the nozzle part against the inside sleeve from the outside, allowing the expansion throttle to be connected to the end hose with a butt joint. It is advantageous if two expansion rings [sic] are provided, one of which surrounds the end hose, and the other of which surrounds the nozzle part of the expansion throttle in the region of the common inside sleeve. At least one of the clamp rings can be formed as a cable clamp and provided with a quick-release coupling, so that the expansion throttle can be quickly attached to or removed from the end hose. Releasing the expansion throttle or moving it out of the way is necessary in order to be able to introduce a resorbable sponge via the outlet opening. The same holds true if a sponge catcher for compressed air cleaning must be coupled to the hose end.

Another preferred form of the invention provides for an insertion socket which can be set into the outlet aperture of the end hose with a positive and non-positive lock, where the expansion throttle can be attached to its end on the inlet side. In this connection, the insertion socket can have a nozzle which projects beyond the outlet aperture of the end hose, for attaching a nozzle part molded onto the expansion throttle, where it is practical if the expansion throttle can be connected with the insertion socket by means of a bayonet-like locking connection or a screw connection.

In order to guarantee secure anchoring of the insertion socket in the end hose material, it is advantageous if the insertion socket can be pressed into the inside surface of the end hose material with barb-like annular ribs, forming a positive lock, and if a clamp sleeve which additionally surrounds the outlet-side end of the end hose on the outside, which can preferably be pressed into the elastomer end hose material with ring-shaped inside ribs, and secures the insertion socket to prevent it from sliding out of the end hose is provided, in addition, if necessary. It is practical if the clamp sleeve and the nozzle part of the expansion throttle are surrounded on the outside by a protective pipe or protective hose which is pushed over the clamp sleeve. In this connection, the rebound sheath can be molded either onto the expansion throttle or onto its nozzle part or onto the protective pipe or protective hose.

BRIEF DESCRIPTION OF THE DRAWINGS

In the following, the invention is explained in greater detail on the basis of an exemplary embodiment shown schematically in the drawing. This shows.

DETAILED DESCRIPTION

Figure 1:
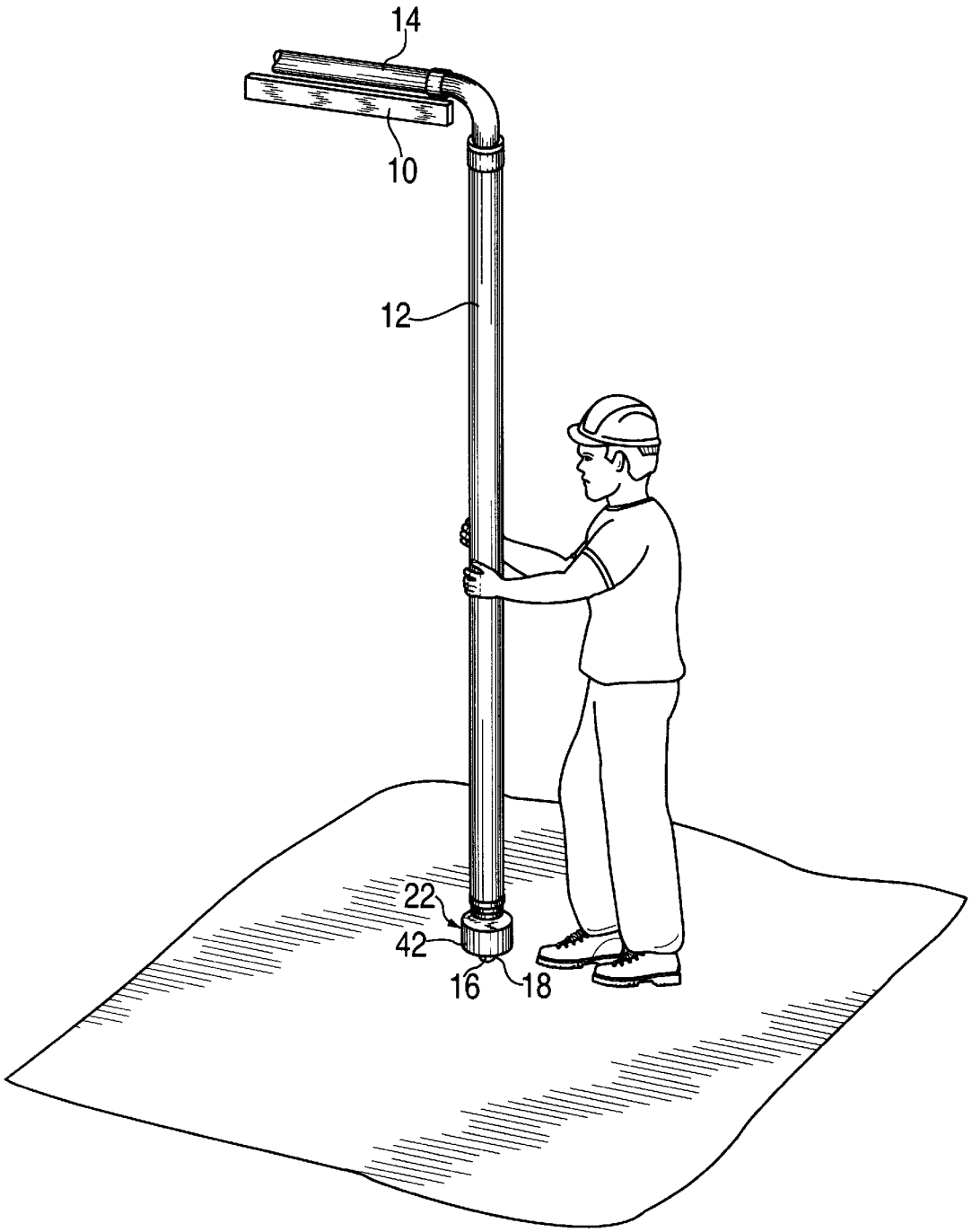
FIG. 1 the mast tip of a distributor mast of a mobile concrete pump with an end hose.

FIG. 1 shows the mast tip 10 of a distributor mast, structured as a bending mast, the remainder of which is not shown, of a mobile concrete pump; this tip carries an end hose 12 which hangs down vertically in the operating state and is connected with a pressure feed line 16 which is passed along the concrete distributor mast, and to which concrete is supplied by a pump; the transported concrete exits into an introduction location on the construction site through the outlet aperture 16 of the hose, which aperture points downward.

At the outlet aperture 16 of the end hose, an expansion throttle 18 is arranged, which is coupled to the end hose 12 with a nozzle part 20 and a hose connector 22, and the throttle part 24 of which has the shape of a cone sleeve which diverges toward its end on the outlet side, and can be elastically spread open under the effect of the exiting concrete. The hose connector 22 has an inside sleeve 26 made of steel, which engages in the outlet aperture 16 of the end hose on its one end, and in the nozzle part 20 of the expansion throttle 18 on its other end. Furthermore, two clamp sleeves 28, 30, formed as cable clamps or hose clamps, for example, are provided, one (28) of which clamps the end hose and the other (30) of which clamps the nozzle part 20 of the expansion throttle against the inside sleeve 26.

Figure 2A:
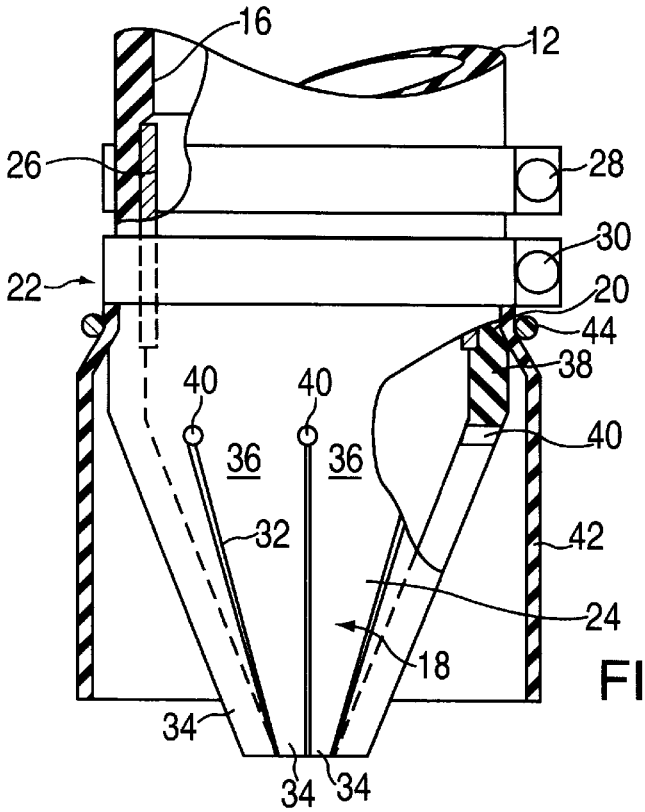
FIGS. 2*a* and *b* a segment of the outlet-side end of the end hose with the expansion throttle not spread and spread, in an enlarged, partially cross-sectional view.
Figure 2B:
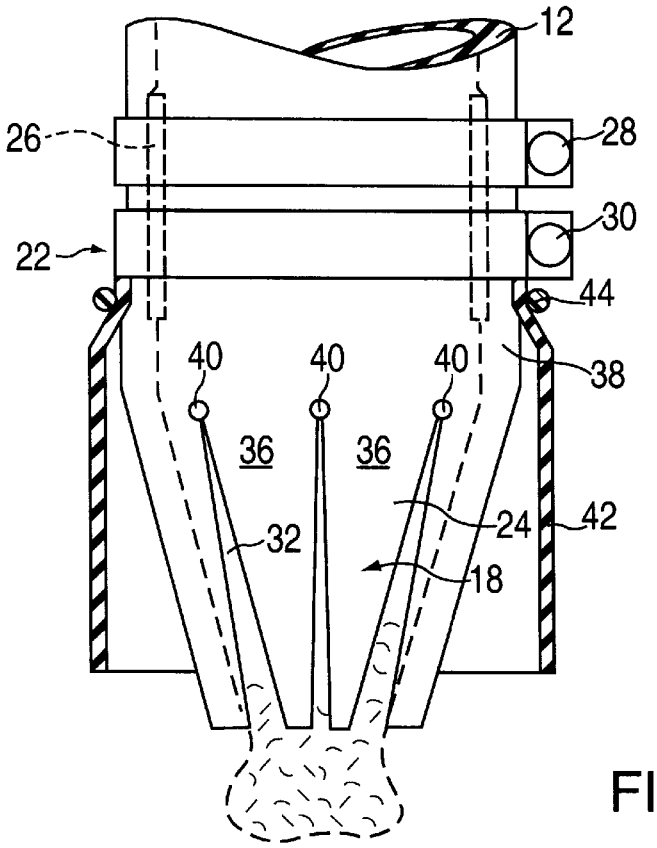

The throttle part 24 has several expansion blades, separated from one another in the circumference direction by means of mantle slits 32, which are connected with one another at their root 36, on the nozzle side, in the region of a circumference bead. The mantle slits 32 are widened at their closed end, forming radial relief apertures 40, and open at their other, outlet-side end. In the non-expanded state, the expansion blades 34 rest against one another in pairs, in the region of the mantle slits, under pre-stress (FIG. 2*a*). Under the effect of the exiting concrete, they are spread open to a greater or lesser degree, depending on the feed volume (FIG. 2*b*). In order to prevent cement milk or concrete components from being laterally expelled to the outside via the mantle slits 32 and the relief apertures 40 by means of enclosed air cushions, the throttle part 24 is concentrically surrounded by a rebound sheath 42, which is attached to the expansion throttle 18 with a clamp element 44 behind the circumference bead 38.

Figure 3A:
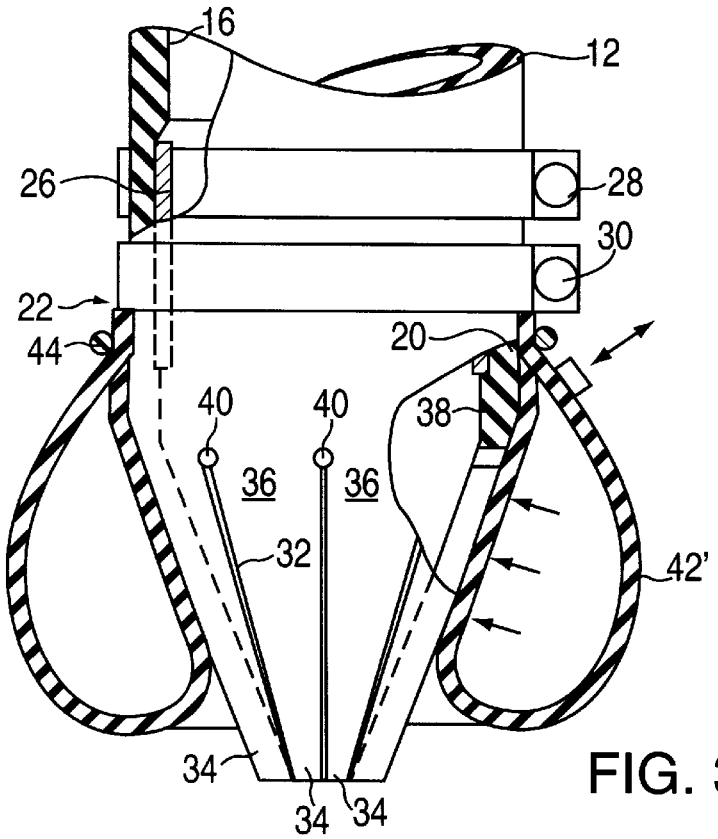
FIGS. 3*a* and *b* an expansion throttle which can be adjusted and closed from the outside, in a representation corresponding to FIGS. 2*a* and *b;*
Figure 3B:
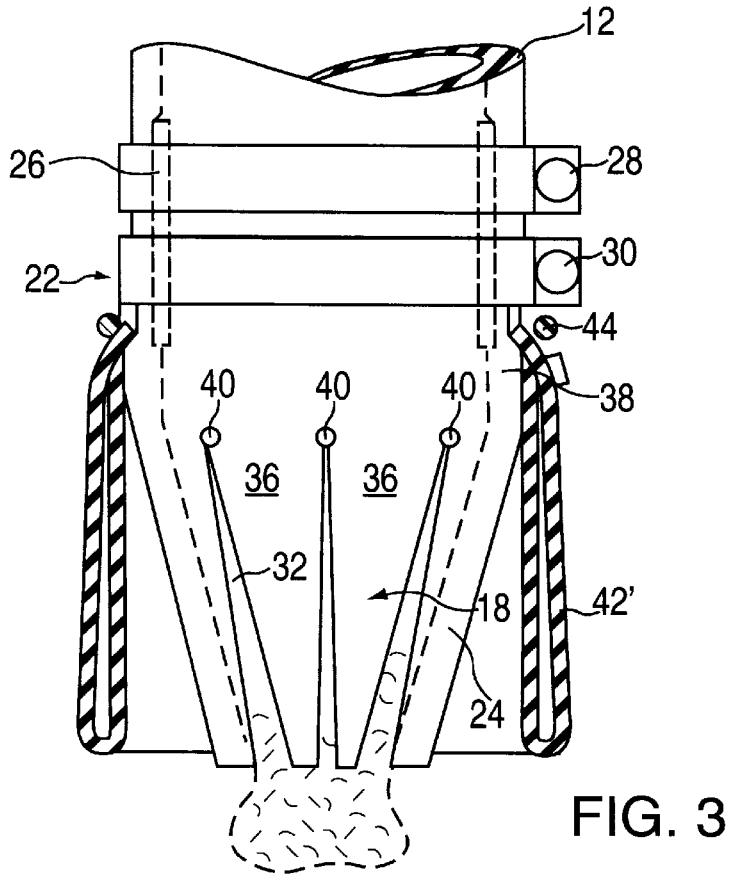

In the exemplary embodiment shown in FIGS. 3*a* and *b*, the rebound sheath 42' is structured as a ring bellows which can be inflated with compressed air, via which the expansion throttle can be pneumatically adjusted or closed in its passage cross-section and/or with regard to its expansion characteristics.

Figure 4A:
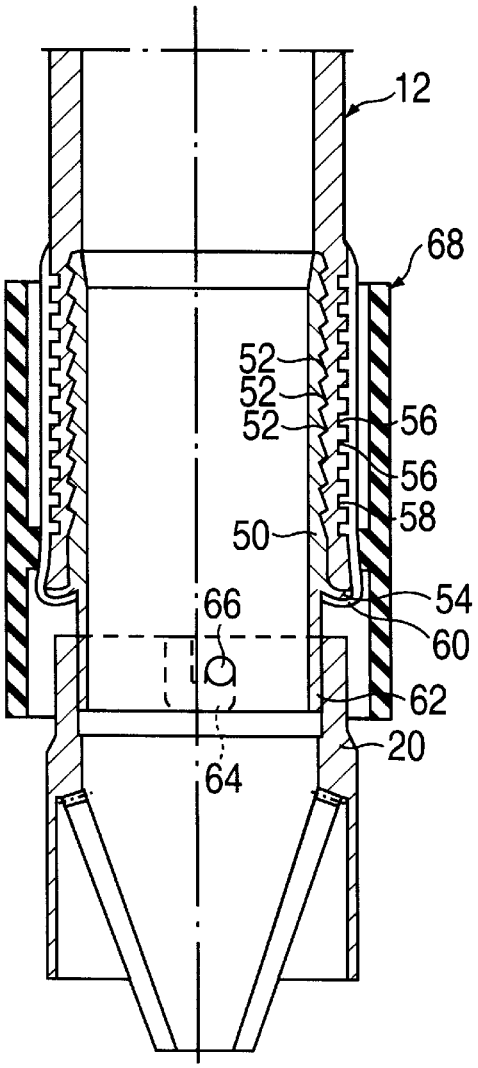
FIGS. 4*a* and *b* a segment of the outlet-side end of an end hose in the assembled state and in an exploded view.
Figure 4B:
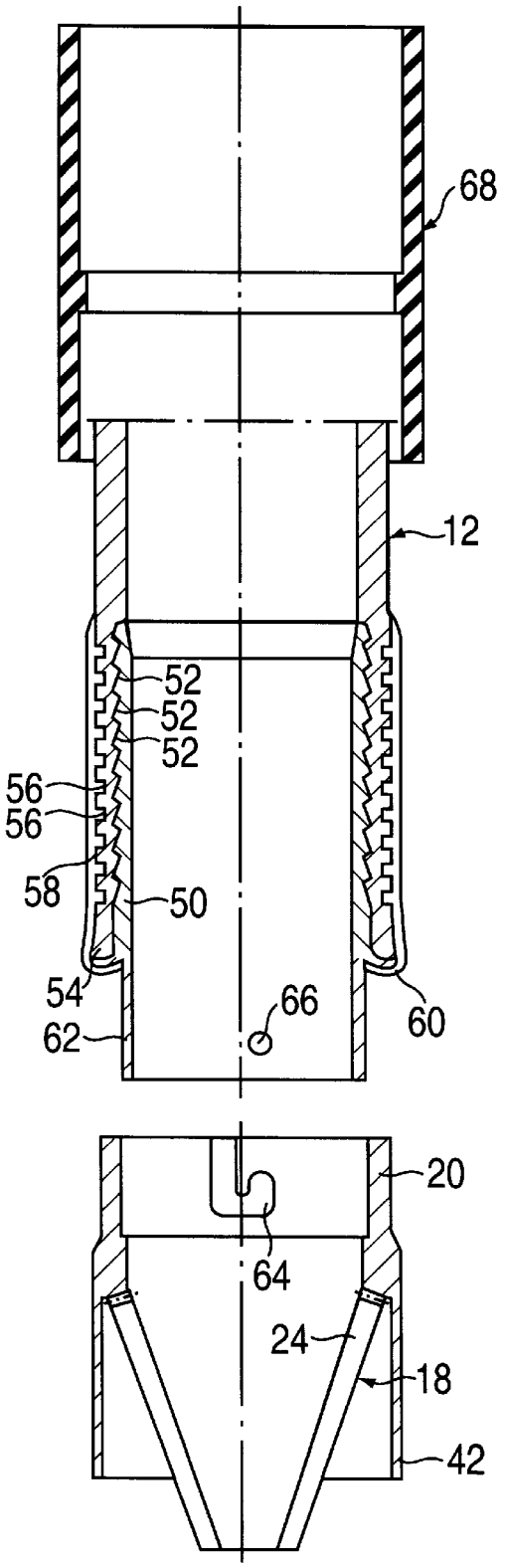

In the preferred exemplary embodiments shown in FIGS. 4*a, b* and 5*a, b*, an insertion socket 50 is inserted into the outlet aperture 16 of the end hose 12, which consists of an elastomer material; the barb-like annular ribs 52 of the socket engage in the end hose material with a positive and non-positive lock, and its ring-shaped projecting collar 54 touches the frontal face of the end hose. Furthermore, a clamp sleeve 58 is provided, which surrounds the outlet-side end of the end hose on the outside, can be pressed into the elastomer end hose material with ring-shaped inside ribs, and secures the insertion socket 50 to prevent it from sliding out of the end hose 12; on the outside, this sleeve touches the collar 54 with its end 60, which is bent away toward the inside. The insertion socket 50 projects beyond the outlet aperture 16 of the end hose 12 with a nozzle 62, onto which the expansion throttle 18, which consists of an elastomer material, can be set with its rear nozzle part 20. For anchoring with a positive lock, at least two catch recesses 64 with open edges are arranged, uniformly distributed over the circumference, on the rear nozzle part 20 of the expansion throttle 18, by means of which the expansion throttle can be locked onto the catch tabs 66 which project radially beyond the nozzle 62, in the form of a bayonet attachment.

Figure 5A:
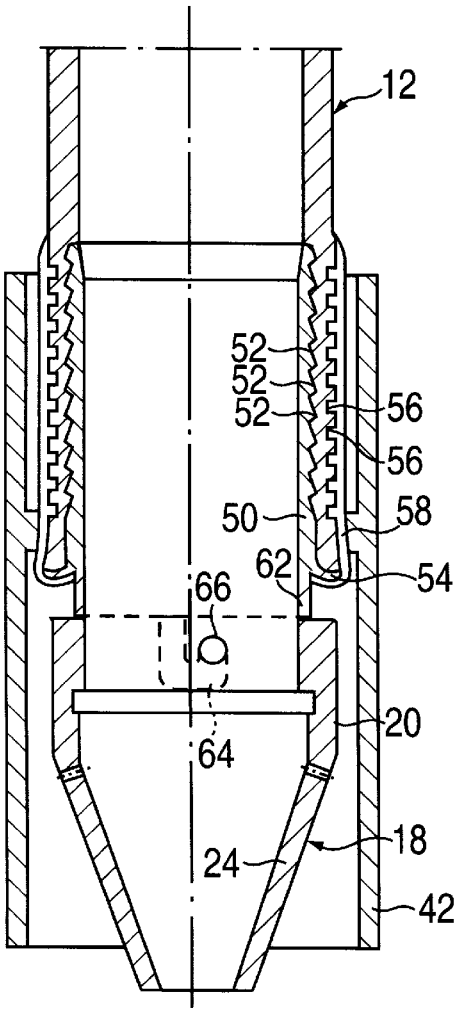
FIGS. 5*a* and *b* a representation corresponding to FIGS. 4*a* and *b* for a modified exemplary embodiment.
Figure 5B:
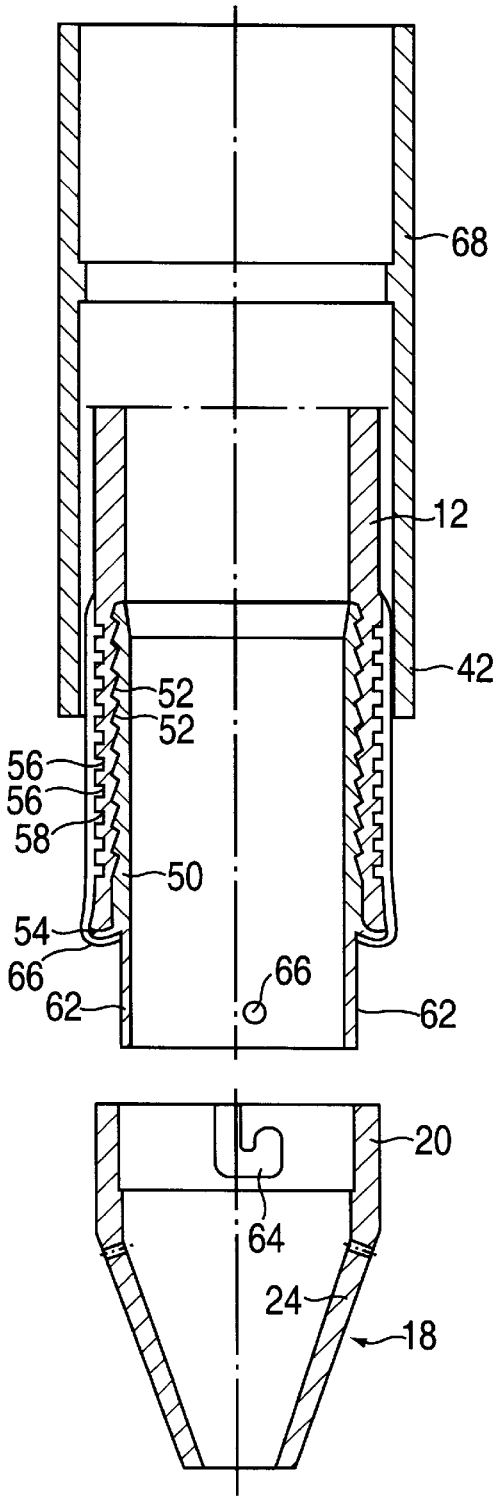

As an alternative, a screw connection is also possible. The clamp sleeve 58 and the nozzle part 20 of the expansion throttle 18 are covered on the outside by a protective pipe or protective hose 68 which is pushed onto the clamp sleeve on the outside and wedged in place on the thicker end of the clamp sleeve 58. In the exemplary embodiment shown in FIGS. 4*a* and *b*, the rebound sheath 42 which surrounds the throttle part 24 of the expansion throttle on the outside is molded onto the outside of the nozzle part 20 of the expansion throttle, while in the case of the exemplary embodiment according to FIGS. 5*a* and *b*, the rebound sheath 42 is formed by means of an extension of the protective pipe or protective hose 68 which surrounds the expansion throttle 18.

In summary, the following should be stated: The invention relates to a pressure feed line for concrete, particularly for use in concrete distributor masts of mobile and stationary concrete pumps. Pressure feed lines of this type generally contain an end hose 12 arranged on the mast tip 10 of the distributor mast, which points down with its outlet aperture 16, via which the transported concrete is discharged on the construction site. In order to avoid undesirable demixing in the end hose, even if the concrete is being pumped slowly, is stiff or low in sand, it is proposed, according to the invention, that an expansion throttle 18 which can be spread open under the effect of the exiting concrete is arranged in the region of the outlet aperture 16 of the end hose 12.

What is claimed is:

1. A feed line for thick materials, particularly concrete, comprising:

an end hose having a downwardly pointing outlet aperture;

an expansion throttle arranged in the region of the outlet aperture and having a throttle surface; and a concentric rebound sheath surrounding at least part of a length of the expansion throttle, the concentric rebound sheath being arranged at a radial distance from the throttle surface.

2. The feed line as recited in claim 1 wherein the end hose is made of an elastomer material.

3. The feed line as recited in claim 4 wherein the expansion throttle comprises:

a nozzle part releasably attached to a delimitation edge of the outlet aperture and having a nozzle part opening cross-section; and a throttle part having a throttle part passage cross-section which can be elastically spread open under the effect of exiting thick materials, the throttle part passage cross-section being smaller than the nozzle part opening cross-section.

4. The feed line as recited in claim 1 wherein the expansion throttle comprises a resiliently deformable material.

5. The feed line as recited in claim 3 wherein the expansion throttle comprises a resiliently deformable material at least in the region of the throttle part.

6. The feed line as recited in claim 3 wherein the throttle part has the shape of a cone sleeve and is capable of being spread open elastically.

7. The feed line as recited in claim 3 wherein the throttle part has a plurality of expansion blades arranged uniformly over a circumference of the throttle part, the expansion blades being separated by mantle slits, and the expansion blades connected with one another at roots near the nozzle part.

8. The feed line as recited in claim 7 wherein the expansion blades rest against one another in a non-expanded state.

9. The feed line as recited in claim 8 wherein the expansion blades in the non-expanded state are pre-stressed.

10. The feed line as recited in claim 7 wherein the mantle slits are widened at the expansion blade roots so as to form pressure relief openings.

11. The feed line as recited in claim 3 wherein the expansion throttle further comprises a circumference bead in a transition region between the nozzle part and the throttle part.

12. The feed line as recited in claim 1 wherein the expansion throttle can be connected to the end hose with a butt joint in which a rigid inside sleeve engages the end hose and a nozzle part of the expansion throttle and in which at least one clamp ring clamps the end hose and the nozzle part against the inside sleeve from the outside.

13. The feed line as recited in claim 12 wherein two clamp rings are provided, one of which surrounds the end hose and the other of which surrounds the nozzle part in a region of the inside sleeve.

14. The feed line as recited in claim 12 wherein the at least one clamp ring is formed as a cable clamp or a hose clamp.

15. The feed line as recited in claim 1 wherein the rebound sheath is releasably attached behind a circumference bead on the expansion throttle or the end hose through a clamp element.

16. The feed line as recited in claim 15 wherein the clamp element provides a positive lock.

17. The feed line as recited in claim 7 wherein the throttle part has at least three mantle slits.

18. The feed line as recited in claim 1 wherein a passage cross-section of the expansion throttle can be adjusted, limited, and/or closed from the outside.

19. The feed line as recited in claim 1 wherein expansion characteristics of the expansion throttle which define a passage cross-section as a function of a transported amount or an inside pressure of exiting thick materials can be adjusted from the outside.

20. The feed line as recited in claim 1 wherein the expansion throttle is surrounded by a ring bellows which can be inflated with compressed air.

21. The feed line as recited in claim 1 wherein the rebound sheath is structured as a ring bellows which can be inflated with compressed air.

22. The feed line as recited in claim 1 further comprising an insertion socket attachable to the outlet aperture with a positive and non-positive lock, and wherein the expansion throttle can be attached to an end of the insertion socket.

23. The feed line as recited in claim 22 wherein the insertion socket has a nozzle which projects beyond the outlet aperture for attaching a nozzle part of the expansion throttle.

24. The feed line as recited in claim 22 wherein the expansion throttle can be connected to the insertion socket through a bayonet-like locking connection or a screw connection.

25. The feed line as recited in claim 22 wherein the end hose is made of an elastomer and wherein the insertion socket can be pressed into an inside surface of end hose with barb-like annular ribs to form a positive lock.

26. The feed line as recited in claim 22 further comprising a clamp sleeve, the clamp sleeve surrounding the end hose from the outside near the outlet aperture and being connected to the insertion socket to prevent it from sliding out of the end hose.

27. The feed line as recited in claim 26 wherein the end hose is made of an elastomer material and the clamp sleeve has ring-shaped inside ribs which engage the end hose.

28. The feed line as recited in claim 26 wherein the expansion throttle has a nozzle part and the clamp sleeve and the nozzle part are surrounded on the outside by a protective hose.

29. The feed as recited in claim 28 wherein the rebound sheath is molded onto the protective hose.

30. The feed line as recited in claim 1 wherein the rebound sheath is molded onto the expansion throttle.

* * * * *

UNITED STATES PATENT AND TRADEMARK OFFICE

CERTIFICATE OF CORRECTION

PATENT NO. : 6,068,025
DATED : May 30, 2000
INVENTOR(S) : Karl Schlecht

It is certified that error appears in the above-identified patent and that said Letters Patent is hereby corrected as shown below:

Column 5, line 38, change "... 4..." to --... 1... --.

Signed and Sealed this

Twenty-second Day of May, 2001

*Attest:*

NICHOLAS P. GODICI

*Attesting Officer*

*Acting Director of the United States Patent and Trademark Office*